US008206147B2

(12) United States Patent
Videto et al.

(10) Patent No.: US 8,206,147 B2
(45) Date of Patent: Jun. 26, 2012

(54) MULTISTAGE GAS FURNACE HAVING SPLIT MANIFOLD

(75) Inventors: Brian D. Videto, Cortland, NY (US); Ruddy C. Bussjager, Cicero, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 13/003,004

(22) PCT Filed: Aug. 6, 2009

(86) PCT No.: PCT/US2009/052928

§ 371 (c)(1), (2), (4) Date: Jan. 7, 2011

(87) PCT Pub. No.: WO2010/017345

PCT Pub. Date: Feb. 11, 2010

(65) Prior Publication Data

US 2011/0111354 A1 May 12, 2011

Related U.S. Application Data

(60) Provisional application No. 61/086,887, filed on Aug. 7, 2008.

(51) Int. Cl.
*F23N 5/00* (2006.01)

(52) U.S. Cl. ..... 431/12; 431/280; 431/255; 431/18; 431/74

(58) Field of Classification Search ..... 431/12, 431/18, 74, 255, 280; 126/116 R; 165/145
See application file for complete search history.

(56) References Cited

U.S. PATENT DOCUMENTS

| | | | | |
|---|---|---|---|---|
| 4,614,491 | A | 9/1986 | Welden | |
| 4,703,747 | A | 11/1987 | Thompson et al. | |
| 4,971,136 | A | 11/1990 | Mathur et al. | |
| 5,513,979 | A * | 5/1996 | Pallek et al. | 431/90 |
| 5,588,298 | A | 12/1996 | Kalina et al. | |
| 5,607,014 | A | 3/1997 | Van Ostrand et al. | |
| 5,682,826 | A | 11/1997 | Hollenbeck | |
| 5,791,332 | A | 8/1998 | Thompson et al. | |
| 5,857,845 | A * | 1/1999 | Paciorek | 431/74 |
| 5,989,020 | A | 11/1999 | Glass et al. | |
| 6,035,810 | A * | 3/2000 | Movassaghi | 122/24 |

(Continued)

FOREIGN PATENT DOCUMENTS

EP 0709629 A1 5/1996

(Continued)

OTHER PUBLICATIONS

International Preliminary Report on Patentability for International application No. PCT/US2009/052928 mailed Feb. 17, 2011.

(Continued)

*Primary Examiner* — Alfred Basichas
(74) *Attorney, Agent, or Firm* — Carlson, Gaskey & Olds PC

(57) ABSTRACT

A heating apparatus for a heat exchanger system includes a manifold having a plurality of burners, a shutoff valve, a first controller and a second controller. The shutoff valve divides the manifold into a first manifold portion and a second manifold portion. The first controller selectively controls the communication of a fluid within the manifold. The second controller selectively actuates the shutoff valve between a first position and a second position to control a firing rate of the plurality of burners.

8 Claims, 3 Drawing Sheets

U.S. PATENT DOCUMENTS

| | | | | |
|---|---|---|---|---|
| 6,161,535 | A | 12/2000 | Dempsey et al. | |
| 6,179,212 | B1 | 1/2001 | Banko | |
| 6,321,744 | B1 | 11/2001 | Dempsey et al. | |
| 6,758,208 | B2 | 7/2004 | Gierula et al. | |
| 6,925,999 | B2 | 8/2005 | Hugghins et al. | |
| 7,101,172 | B2 | 9/2006 | Jaeschke | |
| 7,568,909 | B2 * | 8/2009 | MacNutt et al. | 431/69 |
| 7,654,820 | B2 * | 2/2010 | Deng | 431/74 |
| 2005/0239006 | A1 * | 10/2005 | Specht et al. | 431/12 |
| 2007/0003891 | A1 | 1/2007 | Jaeschke | |
| 2007/0107714 | A1 | 5/2007 | Kurita et al. | |

FOREIGN PATENT DOCUMENTS

| | | | |
|---|---|---|---|
| JP | 59086805 | A | 5/1984 |
| JP | 3028624 | A | 2/1991 |
| JP | 6347010 | A | 12/1994 |
| JP | 2001107140 | A | 4/2001 |

OTHER PUBLICATIONS

International Search Report and Written Opinion of the International Searching Authority for International application No. PCT/US2009/052928 mailed Feb. 22, 2010.

* cited by examiner

MULTISTAGE GAS FURNACE HAVING SPLIT MANIFOLD

CROSS-REFERENCE TO RELATED APPLICATIONS

This application claims priority to U.S. Provisional Application No. 61/086,887, filed Aug. 7, 2008.

BACKGROUND OF THE DISCLOSURE

This disclosure relates to a climate control apparatus, and more particularly to a gas furnace.

Gas furnaces are used to heat residential dwellings and commercial buildings. Heated air is provided to an interior space of the residential dwelling or the commercial building through a plenum. Gas furnaces typically include a main gas valve that communicates gas into a manifold having a plurality of burners for igniting the gas. A desirable feature of a gas furnace is to match the output capacity of the furnace to the heating load required by the interior space of a residential dwelling or commercial building. Commercial buildings, in particular, can benefit from relatively low amounts of heating. Conventional gas furnaces typically provide a limited operating range such that low heat load requirements are not satisfied in many commercial buildings. Modulating furnace systems are also known but have also not effectively satisfied low heat loads that are often required in commercial buildings.

SUMMARY OF THE INVENTION

A heating apparatus for a heat exchanger system includes a manifold having a plurality of burners, a shutoff valve, a first controller and a second controller. The shutoff valve divides the manifold into a first manifold portion and a second manifold portion. The first controller selectively controls the communication of a fluid within the manifold. The second controller selectively actuates the shutoff valve between a first position and a second position to control a firing rate of the plurality of burners.

A heat exchanger system includes a gas valve, a manifold in communication with the gas valve, a shutoff valve, a plurality of burners, a first controller and a second controller. The shutoff valve is positioned downstream from the gas valve and divides the manifold into a first manifold portion and a second manifold portion. The plurality of burners are positioned adjacent to the manifold. A first amount of the plurality of burners are positioned upstream from the shutoff valve within the first manifold portion and a second amount of the plurality of burners are positioned downstream from the shutoff valve within the second manifold portion. The first controller selectively communicates with the first amount of the plurality of burners, and the second controller selectively communicates with the second amount of the plurality of burners.

A method of operating a heat exchanger system includes selectively controlling communication of a fluid to the manifold having a first manifold portion and a second manifold portion with a first controller, and selectively blocking at least a portion of the fluid communicated to at least one of the first manifold portion and the second manifold portion with a second controller that is independent of the first controller.

The various features and advantages of this disclosure will become apparent to those skilled in the art from the following detailed description. The drawings that accompany the detailed description can be briefly described as follows.

DETAILED DESCRIPTION OF THE DISCLOSED EMBODIMENT

Figure 1:
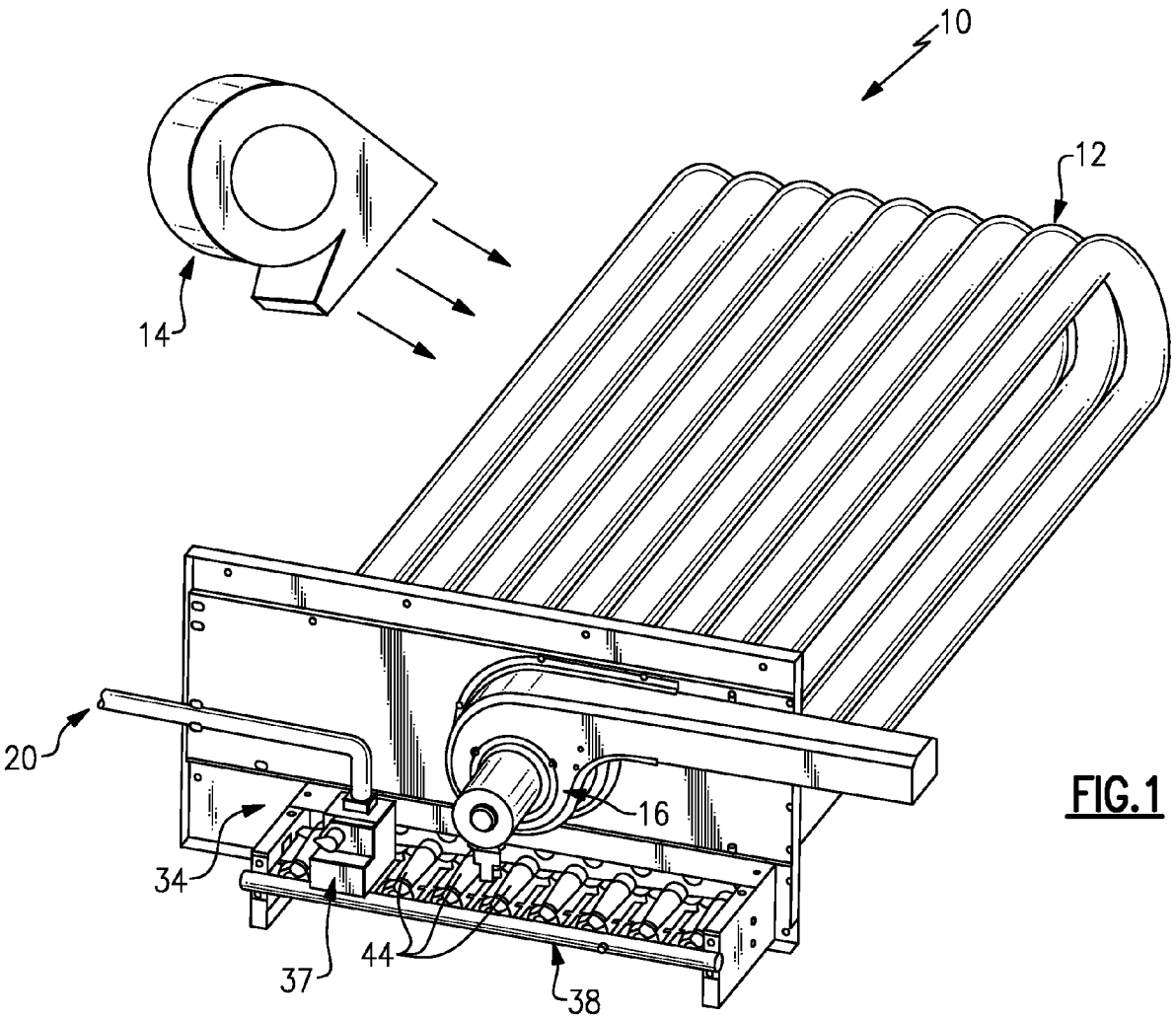
FIG. 1 illustrates a schematic view of an example heat exchanger system.

FIG. 1 illustrates an example heat exchanger system 10 for residential or commercial applications. In one example, the heat exchanger system 10 is a gas furnace. In another example, the heat exchanger system 10 is a gas furnace having multiple heating stages. It should be understood that the description and example illustrations described herein are not limited to a gas furnace. That is, this disclosure is applicable to any type of heat exchanger system.

The example heat exchanger system 10 includes a heat exchanger 12, a circulating air fan 14, a combustion air fan 16, a main gas valve (MGV) 37 and a heating apparatus 34. In one example, the heat exchanger system 10 is a gas furnace rooftop system. The heating apparatus 34 provides a desired level of heat to an interior space. The heating apparatus 34 includes a gas manifold 38 and a plurality of burners 44. A fluid, such as a gas, is communicated through a fluid supply pipe 20, to the MGV 37, and is further communicated to the gas manifold 38.

When the gas manifold 38 is pressurized, a mixture of gas and air is communicated through the plurality of burners 44. At the exit of each burner the fuel-air mixture is ignited, thus establishing a flame 22 (See FIG. 2) stabilized on each burner 44 rim. The flames and additional combustion air are drawn into the heat exchanger 12 with the aid of the combustion air fan 16. The circulating air fan 14 blows air over the heat exchanger 12 to transfer the heat generated by combustion through the heat exchanger 12, to the circulating airflow, and then to an interior space.

Figure 2:
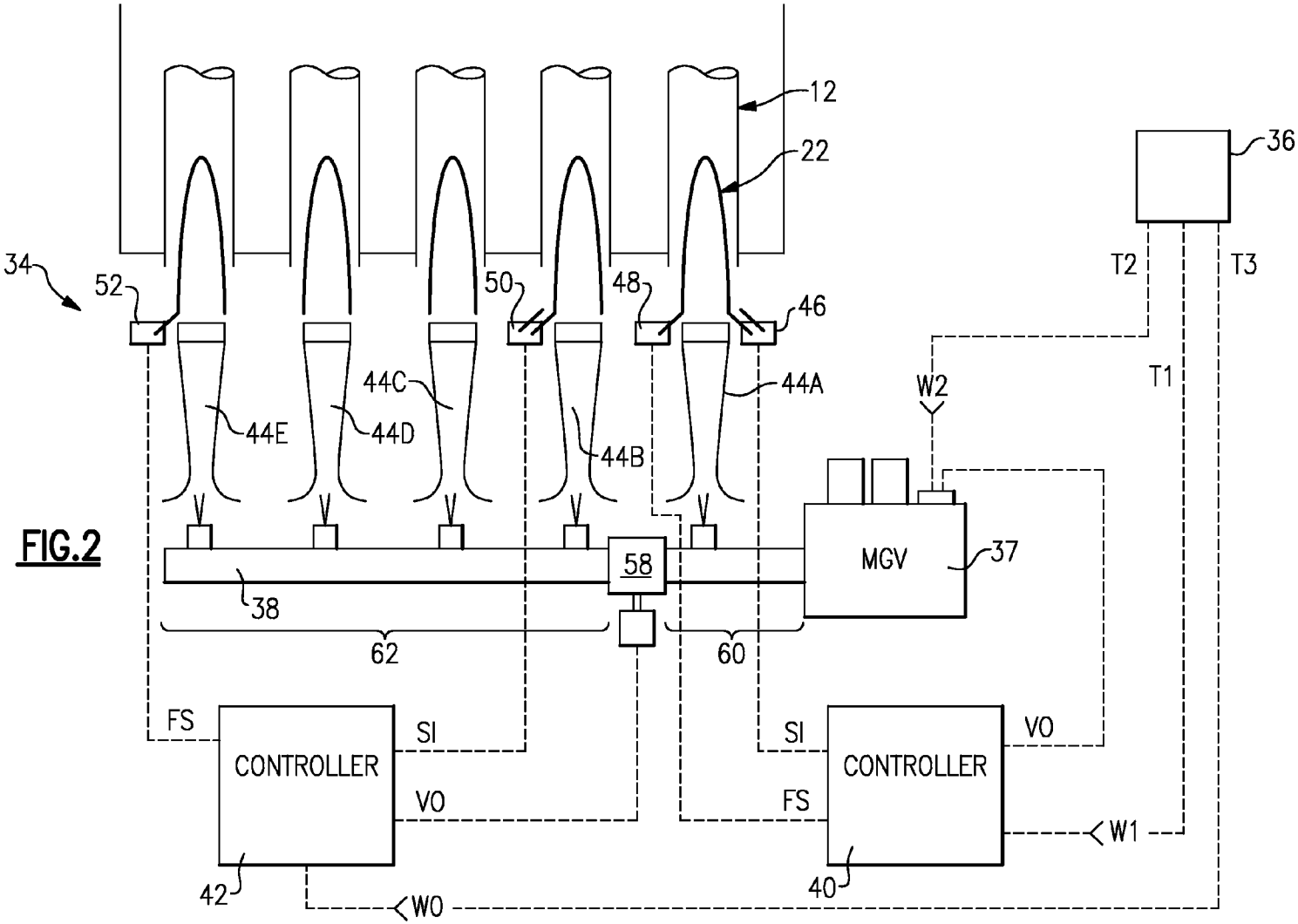
FIG. 2 illustrates an example heating apparatus of the heat exchanger system illustrated in FIG. 1.

FIG. 2 illustrates selected portions of the example heating apparatus 34 for use within the heat exchanger system 10. In this example, the heating apparatus 34 includes the main gas valve (MGV) 37, the gas manifold 38, a first controller 40 and a second controller 42. The manifold 38 includes a plurality of burners 44A, 44B, 44C, 44D and 44E positioned within the manifold 38. In one example, the burners 44A, 44B, 44C, 44D and 44E are Venturi type burners. In another example, the burners 44A, 44B, 44C, 44D and 44E are inshot burners. A person of ordinary skill in the art having the benefit of this disclosure would be able to select an appropriate burner for use within the heating apparatus 34. Additionally, although five burners are illustrated in FIG. 2, it should be understood that the manifold 38 may include any number of burners, and the actual number of burners depends on the output capacity of the heat exchanger system 10.

A first spark electrode 46 and a first flame sensor 48 are associated with the upstream most burner 44A, in this example. The spark electrode 46 lights the burner 44A in response to receiving a spark ignition command SI from the first controller 40. The flame sensor 48 detects the presence of a flame and generates an electrical current FS. The signal FS is received by the first controller 40, thus proving successful ignition. A second spark electrode 50 and a second flame sensor 52 are associated with downstream burners 44B, 44C, 44D and 44E, in another example. The second spark electrode 50 and the second flame sensor 52 are controlled by the second controller 42 to ensure lighting of the burners 44B-44E. The first controller 40 and the second controller 42 are operable to control all functionality of the heating apparatus 34, as is further discussed below. A person of ordinary skill having the benefit of this disclosure would be able to select an appropriate controller for the first controller 40 and the second controller 42.

In one example, the controllers 40, 42 are selected from known components in the industry. A person of ordinary skill in the art would be able to select appropriate controllers for use with the heating apparatus 34. In one example, the first controller 40 is a separate and distinct component from the second controller 42. In this way, the controllers 40, 42 may be used to selectively access and control different components of the heating apparatus 34. A person of ordinary skill in the art having the benefit of this disclosure would be able to program the controllers 40, 42 to operate independently from one another and to perform the required functionality of the heating apparatus 34. For example, the controllers 40, 42 are programmable to provide functionality that includes, but is not limited to, gas valve open/close, spark ignition, flame sensing, combustion fan control, circulating air fan control, and various safety controls.

A shutoff valve 58 is positioned within the manifold 38 and divides the manifold 38 into a first manifold portion 60 and a second manifold portion 62. The shutoff valve 58 is controlled by the second controller 42 to selectively open and close the shutoff valve 58. In one example, the shutoff valve 58 may be actuated between a plurality of positions to control the amount of fluid that is communicated to the manifold 38. The shutoff valve 58 is a solenoid valve, in one example.

In this example, the burner 44A is associated with the first manifold portion 60, and the burners 44B, 44C, 44D and 44E are associated with the second manifold portion 62. The shutoff valve 58 remains closed and thus blocks the communication of a fluid, such as a gas, for example, from the main gas valve 37 to the burners 44B, 44C, 44D and 44E. The shutoff valve 58 receives a valve open signal VO from the second controller 42. Although the present example illustrates only a single burner associated with the first manifold portion 60 and a plurality of burners 44B, 44C, 44D and 44E associated with the second manifold portion 62, it should be understood that the shutoff valve 58 may be positioned at any location within the manifold 38 to control the firing rates associated with the plurality of burners 44A, 44B, 44C, 44D and 44E.

A thermostat 36 is associated with the heating apparatus 34 and communicates with the first controller 40, the second controller 42 and the main gas valve 37 to provide a required level of heating to an interior space. The thermostat 36 includes the necessary logic to command a desired level of heating to the first controller 40, the second controller 42 and the main gas valve 37. A person of ordinary skill in the art having the benefit of this disclosure would be able to program the thermostat 36 with the necessary logic.

In this example, the thermostat 36 includes three electrical lines T1, T2 and T3 for providing the necessary control signals to the heating apparatus 34 for providing multiple stage heating. A control signal W1 is communicated to the first controller 40, a control signal W2 is communicated to the main gas valve 37 and a control signal W0 is communicated to the second controller 42, in this example. The W1 control signal instructs the first controller 40 to either open or close the first stage of the main gas valve 37. The W2 control signal either opens or closes the second stage of the main gas valve 37. The W1 and W2 control signals are similar to control signals used to operate a conventional two stage heating system, for example. The W0 control signal instructs the second controller 42 to either open or close the shutoff valve 58, thus determining whether fluid is communicated to the downstream burners 44B, 44C, 44D and 44E. In one example, the control signals W0, W1 and W2 are 24 volt signals.

Table 1 (See below) illustrates operation of the heating apparatus 34 as programmed with four heating stages. In the illustrated example, when the shutoff valve 58 is open, gas flows to all the burners 44A, 44B, 44C, 44D and 44E, and the heating apparatus 34 operates as a conventional two stage furnace with all burners fired. When the shutoff valve is in the closed position, the heating apparatus 34 operates as a conventional two stage furnace except with a reduced number of burners. In one example, a single burner 44A is operated at two stages.

As illustrated by Table 1, by combining operating of a conventional two stage gas valve 37 with a shutoff valve 58, four different stages of heating are selectable by a user at the thermostat 36. For example, in the first stage of heating, a 14% firing rate is obtained by closing the shutoff valve 58 and operating the main gas valve 37 at its low stage. In the second stage of heating, a 20% firing rate is obtained by closing the shutoff valve 58 and operating the main gas valve 37 at its high stage. A 70% firing rate is obtained at the third stage by opening the shutoff valve 58 and operating the main gas valve 37 at its low stage. Finally, in the fourth stage of heating, a 100% firing rate is achieved by opening the shutoff valve 58 and operating the main gas valve 37 at its high stage. It is to be understood that the actual firing rate achieved at each stage will vary depending upon the total number of burners, the fraction of those burners that are located downstream of the shutoff valve 58, and the high fire to low fire ratio of the main gas valve 37.

TABLE 1

| Stage | Rate | Shutoff Valve | MGV | WO | W1 | W2 |
|---|---|---|---|---|---|---|
| 4 | 100% | Open | High | ON | ON | ON |
| 3 | 70% | Open | Low | ON | ON | OFF |
| 2 | 20% | Closed | High | OFF | ON | ON |
| 1 | 14% | Closed | Low | OFF | ON | OFF |

Figure 3:
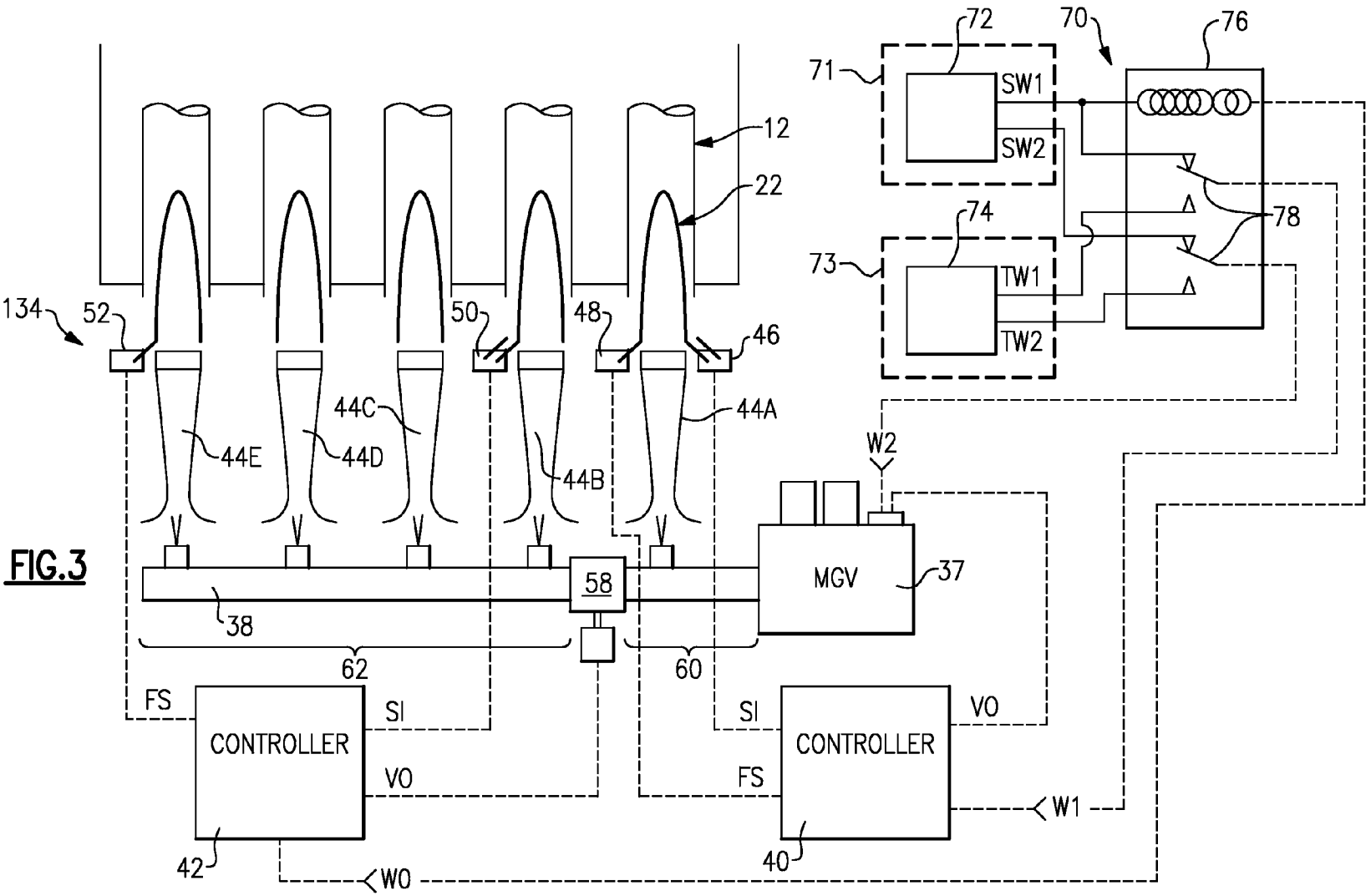
FIG. 3 illustrates another example heating apparatus for a heat exchanger system.

FIG. 3 illustrates selected portions of another example heating apparatus 134 for use within a heat exchanger system to provide multiple stage heating to an interior space 71, such as the interior space of a commercial building, for example. In this disclosure, like reference numerals designate like elements where appropriate, and reference numerals with the addition of 100 or multiples thereof designate modified elements. It is to be understood that the modified elements incorporate the same features and benefits of the corresponding original elements, except where stated otherwise.

The example heating apparatus 134 is similar to the heating apparatus 34; however, in this example, the hearting apparatus includes a thermostat system 70. In this example, the thermostat system 70 includes a first thermostat 72, a second thermostat 74 and a relay 76. The first thermostat 72 is a conventional two stage thermostat located in the interior space 71, and the second thermostat 74 is a separate, two stage thermostat positioned within a space 73 where the conditioned air exits the heat exchanger system 10. The relay 76 selectively determines which of the first thermostat 72 or the second thermostat 74 connects to the controllers 40, 42 (via switches 78, for example), which in turn control the functionality of the heating apparatus 134 to provide a desired level of heating to the interior space 71.

The thermostat system 70 provides the user with a selection of four different stages of heating. In this example, the first thermostat 72 operates in a heating mode to heat the interior space 71 in either a third stage or a fourth stage of heating (See Table 1), and the second thermostat 74 operates in a tempering mode in either a first stage or second stage of heating.

For example, a heating mode is initiated whenever the first thermostat 72 commands a low stage heat signal SW1. The thermostat system 70 includes the necessary logic to command a desired level of heating to the first controller 40, the second controller 42 and the main gas valve 37. A person of ordinary skill in the art having the benefit of this disclosure would be able to program the thermostat system 70 with the necessary logic. When the heating mode is initiated by the thermostat system 70, the relay 76 electrically connects the low stage heat signal SW1 and the high stage heat signal SW2 to the control signals W1, W2, respectively, via switches 78. At the same time, the signal SW1 is input to the controller 42, which activates the second manifold portion 62 of the manifold 38 to provide the desired level of heating. One of ordinary skill in the art having the benefit of this disclosure would recognize that in this mode the heating apparatus 134 behaves similarly to a conventional two stage furnace.

If there is no requirement from the thermostat system 70 for heating the interior space 71, the first thermostat 72 removes the low stage heat signal SW1. The second manifold portion 62 is then deactivated. In addition, the relay 76 toggles to the second thermostat 74, which electrically connects control signals W1, W2 to tempering thermostat signals TW1, TW2, respectively. The heating apparatus 134 is then capable of providing either first or second stage heat from the first manifold portion 60 in response to the communication of either tempering signal TW1 or tempering signal TW2.

These features could operate in conjunction with a economizer system, which mixes return air from a building with fresh outdoor air to be supplied to the building. When the temperature of this mixed air is below a certain set point, the second thermostat 74 commands for first or second stage heat to increase mixed air temperature to a more comfortable range.

The foregoing description shall be interpreted as illustrative and not in any limiting sense. A worker of ordinary skill in the art having the benefit of this disclosure would recognize that certain modifications would come within the scope of this disclosure. For these reasons, the following claims should be studied to determine the true scope and content of this disclosure.

What is claimed is:

1. A heat exchanger system, comprising:

a gas valve;

a manifold in fluid communication with said gas valve;

a shutoff valve positioned downstream from said gas valve and dividing said manifold into a first manifold portion and a second manifold portion;

a plurality of burners positioned adjacent to said manifold, wherein a first amount of said plurality of burners are positioned upstream from said shutoff valve within said first manifold portion and a second amount of said plurality of burners are positioned downstream of said shutoff valve within said second manifold portion;

a first controller that selectively communicates with said first amount of said plurality of burners; and a second controller that selectively communicates with said second amount of said plurality of burners.

2. The system as recited in claim 1, comprising a thermostat operable to selectively communicate a control signal to each of said gas valve, said first controller and said second controller.

3. The system as recited in claim 1, comprising a thermostat system having a first thermostat, a second thermostat and a relay, wherein said thermostat system is operable to selectively communicate control signals to each of said gas valve, said first controller and said second controller.

4. The system as recited in claim 1, comprising at least one spark electrode and at least one flame sensor associated with said plurality of burners.

5. The system as recited in claim 1, wherein a first spark electrode and a first flame sensor are associated with said first amount of said plurality of burners and a second spark electrode and a second flame sensor are associated with said second amount of said plurality of burners.

6. The system as recited in claim 5, wherein said first controller controls said first spark electrode and said first flame sensor and said second controller controls said second spark electrode and said second flame sensor.

7. The system as recited in claim 1, wherein said second controller selectively actuates said shutoff valve between a first position and a second position to control a firing rate of said plurality of burners.

8. The system as recited in claim 7, wherein said first position is a closed position and said second position is an open position, and said fluid is blocked from said second amount of said plurality of burners in response to said shutoff valve being positioned at said first position.

* * * * *